US007951021B2

(12) United States Patent
Lessack

(10) Patent No.: US 7,951,021 B2
(45) Date of Patent: May 31, 2011

(54) TARGET BALL GAME KIT

(76) Inventor: Robert A. Lessack, New Rochelle, NY (US)

( * ) Notice: Subject to any disclaimer, the term of this patent is extended or adjusted under 35 U.S.C. 154(b) by 0 days.

(21) Appl. No.: 12/313,201

(22) Filed: Nov. 18, 2008

(65) Prior Publication Data

US 2010/0125012 A1 May 20, 2010

(51) Int. Cl.
*A63B 67/00* (2006.01)

(52) U.S. Cl. ..... 473/490; 273/400; 473/465

(58) Field of Classification Search ..... 273/317, 273/336, 337, 398–402, 348; 473/465, 473, 473/474, 197, 470, 490
See application file for complete search history.

(56) References Cited

U.S. PATENT DOCUMENTS

| | | | | | |
|---|---|---|---|---|---|
| 1,935,370 | A | | 11/1933 | Nekuda | 273/341.1 |
| 2,050,914 | A | | 8/1936 | Anderson | 273/401 |
| 3,091,461 | A | | 5/1963 | Taylor | 273/341.1 |
| 3,406,972 | A | | 10/1968 | Poole | 273/123 R |
| 3,490,769 | A | * | 1/1970 | Torbett | 473/196 |
| 3,526,405 | A | * | 9/1970 | Morris | 473/191 |
| 4,093,226 | A | | 6/1978 | Priestle | 273/343.1 |
| 4,171,134 | A | * | 10/1979 | Reck | 473/196 |
| 4,239,221 | A | * | 12/1980 | Griffin | 273/127 R |
| 4,796,886 | A | * | 1/1989 | Loh | 473/462 |
| 4,844,478 | A | * | 7/1989 | Kessler | 473/474 |
| 4,979,754 | A | | 12/1990 | Eisenhart | 473/474 |
| 4,986,549 | A | | 1/1991 | Kuhtic et al. | 273/402 |
| 5,056,795 | A | * | 10/1991 | Buhrow | 273/400 |
| 5,230,650 | A | * | 7/1993 | Brayton | 473/402 |
| 5,246,228 | A | * | 9/1993 | Hope, II | 473/465 |
| 5,282,635 | A | | 2/1994 | Hopkins | 273/342 |
| 5,290,043 | A | * | 3/1994 | Vidinic | 473/446 |
| 5,324,042 | A | | 6/1994 | Demas | 273/348.4 |
| 5,383,665 | A | * | 1/1995 | Schultz et al. | 473/159 |
| 5,401,027 | A | * | 3/1995 | Surbeck | 473/173 |
| 5,431,265 | A | | 7/1995 | Yoo | 190/103 |
| 5,470,057 | A | * | 11/1995 | Bodford, Jr. | 473/416 |
| 5,741,194 | A | * | 4/1998 | Simunek | 473/490 |
| 6,161,833 | A | | 12/2000 | Gomez | 273/400 |
| 6,168,541 | B1 | * | 1/2001 | Gibbs | 473/497 |
| 6,241,621 | B1 | * | 6/2001 | Maher | 473/185 |
| 6,569,028 | B1 | * | 5/2003 | Nichols et al. | 473/192 |
| 6,699,137 | B2 | * | 3/2004 | Szymanski | 473/169 |
| 6,869,374 | B1 | | 3/2005 | Lane | 473/578 |
| 6,875,121 | B2 | | 4/2005 | McKeen | 473/168 |
| 6,988,964 | B2 | | 1/2006 | Buckfield | 473/415 |
| 7,192,360 | B2 | * | 3/2007 | Tamulewicz | 473/162 |
| 7,270,332 | B2 | | 9/2007 | McClung et al. | 273/338 |
| 7,311,619 | B1 | | 12/2007 | Leftwich | 473/474 |
| 7,401,785 | B1 | * | 7/2008 | Waite | 273/400 |
| 2003/0008721 | A1 | * | 1/2003 | Macaluso | 473/197 |
| 2005/0197197 | A1 | | 9/2005 | Scott | 473/173 |
| 2005/0213342 | A1 | * | 9/2005 | Tufte | 362/551 |
| 2006/0091609 | A1 | * | 5/2006 | Dovrat et al. | 273/398 |

* cited by examiner

*Primary Examiner* — Mark S Graham
(74) *Attorney, Agent, or Firm* — Ernest D. Buff; Ernest D. Buff & Associates LLC; Margaret A. La Croix, Esq.

(57) ABSTRACT

A target ball game kit is provided that is easily carried and readily assembled to facilitate play in recreational areas such as parks or beaches. The kit includes a container housing a plurality of paddles, a plurality of balls having varying weights, and at least one target assembly. The target assembly is appointed to be set-up on a ground surface and secured thereto by way of securing means. Concentric rings having assigned point values are constructed within the target assembly. The target assembly preferably is constructed of a continuous rope or cord-like member. The kit can be readily and accurately adjusted for singles to doubles play by including at least two target assemblies therein. Glow in the dark properties may be provided to the target assembly, paddles, and/or balls for play in dimly lit or foggy conditions.

12 Claims, 8 Drawing Sheets

TARGET BALL GAME KIT

BACKGROUND OF THE INVENTION

1. Field of the Invention

The present invention relates to a target ball game kit for providing game play on a surface; and more particularly to a target ball game kit having at least one rope/cable/flexible target assembly and a plurality of light-weight portable items needed to play a target ball game on a beach, or on a grassy area, that can easily be carried and set-up with minimal effort.

2. Description of the Prior Art

Recreational sport activities are frequently played at parks, beaches, or other outside areas. However, areas remote from one's home or playground, can present an environment that creates complexities for game play, especially when a plethora of equipment is needed, as well as a playing court or target assembly.

Several games require erection of nets or boundaries. Net assembly game kit examples can be found in, U.S. Pat. No. 4,844,478 to Kessler and U.S. Pat. No. 4,979,754 to Eisenhart. These types of games are similar to volleyball, and do not involve target assemblies. Moreover, erection of nets and the like can be time consuming and requires a rather large play area, which, on a crowded beach or park, can be difficult. Also, various dart games have been provided that cannot be readily played at beach, or high traffic park, as they require a vertical surface to mount a target upon and involve throwing of sharp dart projectiles, such as U.S. Pat. No. 6,869,374 to Lane.

Other games do not require the erection of nets or boundaries, but have flaws in that many cannot be readily transported and carried into recreational areas. For example, various game apparatuses involve bulky projectile apparatus supports for shooting a ball or missal-like projectile at a target, including, U.S. Pat. No. 1,935,370 to Nekuda and Foreign Publication No. GB2050177 to Logan. These game apparatuses do not disclose a portable game assembly housed within a kit container. At best they disclose a target, projectile, and a projectile shooting apparatus. Moreover, these game apparatuses are not feasible for use in many recreational areas as they can be quiet cumbersome to carry and transport to the beach, park or other recreational area.

Several game apparatuses heretofore disclosed and utilized are not constructed for compact storage, transport and carrying onto a beach or grassy field in a park. For example: U.S. Pat. No. 2,050,914 to Anderson; U.S. Pat. No. 3,091,461 to Taylor; U.S. Pat. No. 3,406,973 to Poole; U.S. Pat. No. 4,093,226 to Priestle; U.S. Pat. No. 4,986,549 to Kuhtic, et al.; U.S. Pat. No. 5,282,635 to Hopkins; U.S. Pat. No. 5,324,042 to Demas; U.S. Pat. No. 6,161,833 to Gomez; U.S. Pat. No. 7,270,332 to McClung, et al.; U.S. Patent Application Publication No. 2005/0197197 to Scott. These bulky game apparatuses generally include rigid game boards or target assemblies that cannot be folded to facilitate portability. Further, many of these game boards and targets are constructed of heavy materials, such as wood, thereby lacking lightweight construction for carrying. Consequently, a user must carry the cumbersome, bulky game boards or targets around when visiting a recreational area, which can be quite challenging if toting other gear, such as food, towels, and the like. Moreover, these rigid game boards and targets generally cannot be utilized on a surface that is not substantially flat without irregularities, because it would cause an unstable, wobbly playing board or target.

Assorted game apparatuses do not provide a target or court assembly, but require users to draw their own lines via drawing lines in sand, paint, chalk or by using tape, including those found in: U.S. Pat. No. 6,875,121 to McKeen; U.S. Pat. No. 6,988,964 to Buckfield; and U.S. Pat. No. 7,311,619 to Leftwich.

Additional game apparatuses fail to provide a court or target assembly altogether, including, for example, the "Paddle Ball Game" found at http://www.toysplash.com/Product/PaddleBallGame which discloses paddles and a ball, and U.S. Pat. No. 5,431,265 to Yoo which discloses a multi-compartment bag. These types of games fail to provide a plurality of paddles and balls and further fail to provide a court/target assembly.

Even still, other game device fail to provide a plurality of game equipment and only provide a court and/or target assembly, failing to present an all inclusive game play kit. For examples, see: U.S. Pat. No. 3,490,769 to Torbett and Foreign Publication No. CA2347310 to Renaud. These game apparatuses merely provide target and/or court assemblies, and are not gaming kits that provide requisite game play equipment along with the court assembly/target assembly. Any resultant use of such game devices would require foraging for and separately toting all related playing equipment.

Notwithstanding the efforts of prior art workers to construct game kits for set-up and play in recreational areas, there remains a need in the art for a target ball game kit that includes a plurality of gaming equipment, pieces, and a court assembly/target assembly compactly disposed in a carrying bag or container. In addition, there exists an art recognized need for a target ball game kit that includes a unilateral target assembly that can readily be placed on a surface and secured thereto to yield a game playing target. Further needed is a target ball game kit that can accommodate one, two, three or four players.

SUMMARY OF THE INVENTION

The present invention provides a target ball game kit that includes a plurality of gaming equipment, pieces, and a court assembly disposed in a carrying bag or container. The target ball game kit is appointed for providing ready game play on a surface in a recreational area, such as a beach or park, is provided by the present invention. All requisite play equipment and a target assembly are provided within a carrying bag or container, including a plurality of paddles, balls and at least on target assembly. The target assembly of the target ball game kit has a lightweight construction and can readily be placed on a surface and secured thereto to yield a target having concentric rings, each of which is assigned a respective point value.

The target ball game kit comprises a kit container that is portable in nature, and houses a plurality of paddles, a plurality of balls having varying weights, and at least one target assembly. The target assembly is appointed to be set-up on a ground surface and secured thereto by way of securing means. A plurality of concentric rings is constructed within the target assembly. These concentric rings, preferably including at least three rings, are each assigned a respective point value.

The plurality of paddles may be provided as a plurality of skill-level paddle sets, wherein each of the skill-level paddle sets are constructed for different game play levels. These game play levels include novice, intermediate, and professional. Each different skill-level paddle set is demarcated to indicate the skill-level. This demarcation can be accomplished by color coordination. Optionally, each of paddles are appointed to be visible in dusk or dimly lit conditions by having a glow-in-the-dark material or surface integrated with or removably attached to each of the paddles. The paddles may comprise a rim having a hollow core and a transparent lip, the hollow core being appointed with an electroluminescent light strip housed therein activated by a power source located within a handle portion of the paddle.

The plurality of balls preferably comprises a plurality of skill-level ball sets, wherein each of the skill-level ball sets are constructed for different game play levels, including novice, intermediate, and professional play levels. Each of the different skill-level ball sets is demarcated to indicate the skill-level, preferably by way of color coordination. The balls may further be appointed to be visible in dusk or dimly lit conditions by having a glow-in-the-dark material or reflective surface.

In one embodiment the target assembly is composed of a rope or cord. The rope or cord of the target assembly may further include an outer surface with phosphorous bound thereto for glow-in-the-dark properties for night or evening play, or play in foggy conditions. The outer surface of the cord or rope may include a reflective portion thereon. Alternatively, the rope or cord of the target assembly includes an outer surface constructed with at least one transparent portion surrounding an electroluminescent lighting core, and wherein the target assembly includes a battery power supply activated by a control switch for providing current to the electroluminescent lighting core. Wherein the target assembly is composed of a rope or cord, the target assembly may include at least one connection portion extending between each of the concentric rings so that the concentric rings are interconnected to one another. The connection portions may be removable from each related concentric ring so that the rings can be removed to create a varying number of the concentric rings of the target assembly. Optionally, the connection portions include removable point segments with the respective point value included thereon so that the point segments show the respective point value assigned to each of the concentric rings. Optionally, the rope or cord of the target assembly includes a mesh material spanning between each of the concentric rings so that the concentric rings are interconnected to one another. The mesh may include removable point segments with the respective point value included thereon so that the point segments show the respective point value assigned to each of the concentric rings.

In another embodiment, the target assembly comprises an outermost flexible deformable ring under tension and surrounded by a mesh material. Accordingly, the other concentric rings are demarcated on the mesh material by stitching or other markings. When the target assembly is twisted to form a figure eight, the outermost flexible deformable ring becomes two overlapping smaller rings which fold upon themselves and one another to yield a folded condition for easy, flat storage within the container. When the target assembly is removed from the container the outermost flexible deformable ring springs to yield an open play condition.

Optionally, the respective point value related to each of the rings comprises an outer number surface with phosphorous bound thereto for glow-in-the-dark properties for visibility during night or evening play, or play in foggy conditions. Moreover, the target ball game kit may further comprise a play line demarcation member. The play line demarcation member may be removably connected to the target assembly. For doubles game playing, at least two target assemblies are provided within the game kit. Additionally, the kit may further contain a coin device for determining play order, rule book containing game playing rules and a player score keeping book or journal.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE INVENTION

A target ball game kit for providing ready game play on a surface in a recreational area, such as a beach or park, is provided by the present invention. All requisite play equipment and a target assembly are provided within a carrying bag or container, including a plurality of paddles, balls and at least one target assembly. The target assembly of the target ball game kit has a lightweight construction and can readily be placed on a surface and secured thereto to yield a target having concentric rings having individually assigned point values.

Target Ball is typically played on a beach or other outdoor area. It can accommodate one, two, three or four players. The target ball game kit includes needed equipment and can easily be carried to a location and set-up with minimal effort. The target ball game kit is played similarly to Skee Ball or Shuffle Board and is played as a singles event, wherein at least one target assembly is provided, or with teams or doubles, wherein at least two target assemblies are provided; preferably, the target ball game kit utilizes the same paddle and ball construction as that used in "Bob-O-Ball".

Figure 1A:
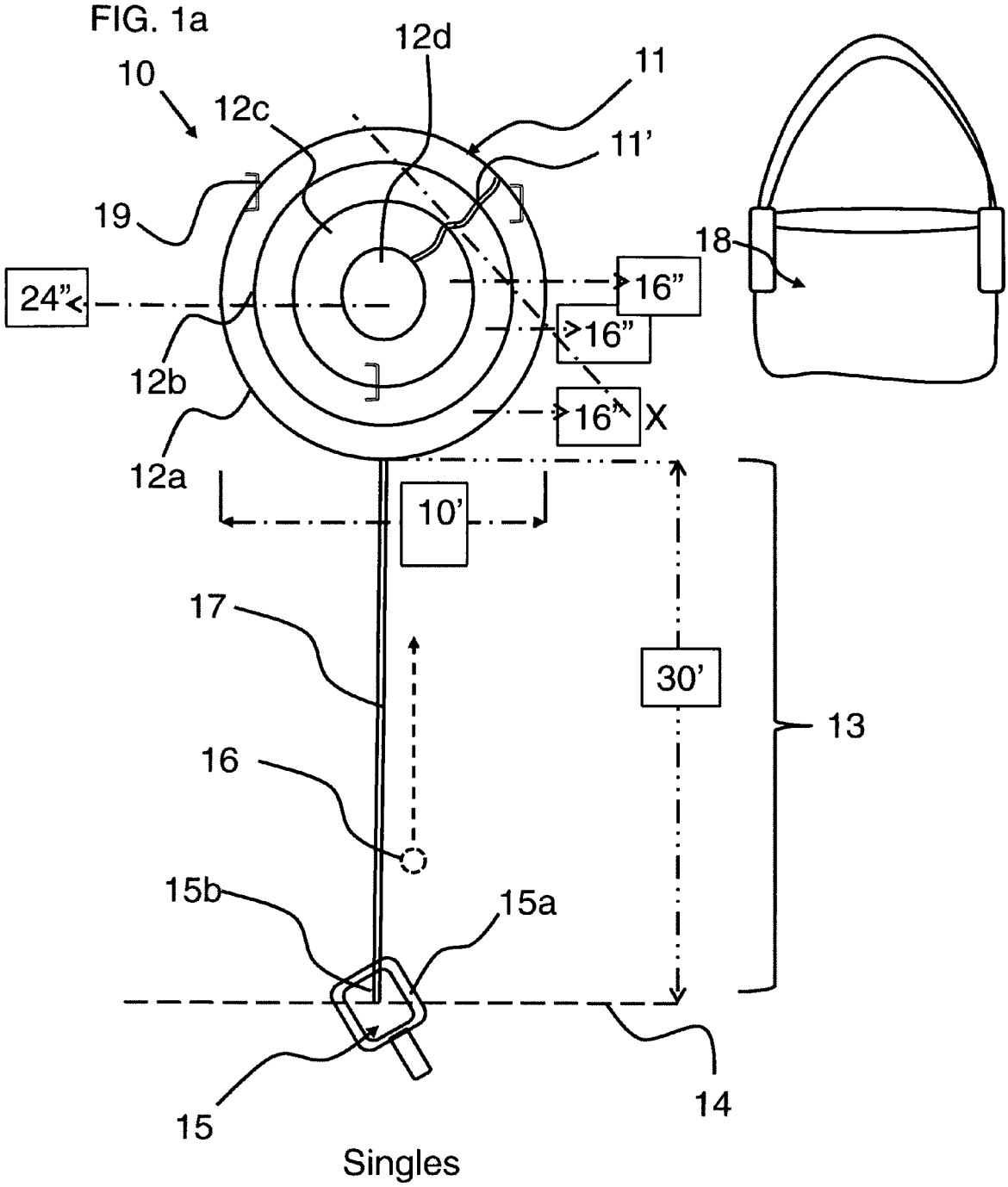
FIG. 1*a* illustrates a top schematic view of an embodiment of the target ball game kit assembled on the ground for a singles game.

FIG. 1*a* illustrates an aerial view of the target ball game kit assembled on the ground for a singles game, shown generally at 10. Target ball game kit 10 includes a kit container 18, herein shown as a bag, being portable in nature, housing a plurality of paddles 15. Kit container 18 is portable in nature, and is constructed of a durable light weight material, such as a mesh bag. Paddles 15 are of different sizes, weights and materials and are manufactured from wood, plastics and rubber coatings, each having different characteristics. Paddles 15 may be provided as a plurality of skill-level paddle sets for different game play levels, including novice, intermediate and professional which provide guidelines for the construction of paddle 15. At least four paddles are provided in each skill-level paddle set so that players of the same skill set can play a game appointed for four player double court game play. "Professional" skill-level paddles 15 must be constructed according to strict guidelines as to surface treatment and dimensions of the striking surface. Target ball game kit 10 preferably utilizes the same paddle and ball construction as that used in "Bob-O-Ball". A plurality of balls 16 is provided. Like paddles 15, varying balls 16 may be provided for the different game play levels, novice, intermediate and professional, and vary accordingly in weigh, color and characteristics. Preferably, balls 16 are coated with or include therein a glow in the dark substance for night play.

Paddles 15 may include a glow in the dark surface for night play. The glow in the dark surface may be provided via a phosphorous material adhered to the striking surface or rim 15*a* around the striking surface. Alternatively, reflective material may be adhered to striking surface 15*b* of paddle 15 to provide reflective visibility. In another embodiment, paddles 15 may be provided with an electroluminescent light source constructed within the paddles, particularly rim 15*a* preferably includes a hollow core and transparent lip or shell that both circumferentially encircling a substantial portion of rim 15*a* to provide an internal groove or area appointed for housing an electroluminescent strip/cord powered by current controlled by an on/off switch located near the handle of the paddle powered by a battery, or controlled by a light sensor located on the rim 15*a* powered by a battery.

A plurality of balls 16 is provided. Like paddles 15, varying skill-level ball sets are preferably provided for the different game play levels, novice, intermediate and professional. These varying balls 16 connote the different game play levels by varying in weight, color and like characteristics. Preferably, balls 16 are coated with or have integrated therewith a glow-in-the-dark substance for night play, and include color coated or demarcation features so that the different play level paddles or balls can be readily discerned. The glow in the dark surface of ball 16 may be provided via a phosphorous material adhered to the surface. Alternatively, a reflective strip may be adhered to ball 16 to provide reflective visibility. The utilization of the glowing properties of ball 16 and paddle 15 provides the ability to play the game during dusk or dimly lit conditions, or during foggy or misty conditions, while at the same time providing safety to the players and others in proximity of the game. Optionally, a coin or other deciding device may be included in the kit along with a rule book and a player score keeping book or journal.

A target assembly 11 is provided within container 18 and is appointed to be laid on a ground and secured into place by way of securing means 19 to yield a playing field including a plurality of concentric rings, 12*a*-12*n*, herein 12*a*-12*d*. Securing means 19 may be of any type of stake or weight, herein they inverted u-shaped stakes are provided and dispersed along the perimeter of target assembly 11. FIG. 1*a* is shown as a singles game court. Doubles may be provided as per FIG. 2 herein.

Figure 4A:
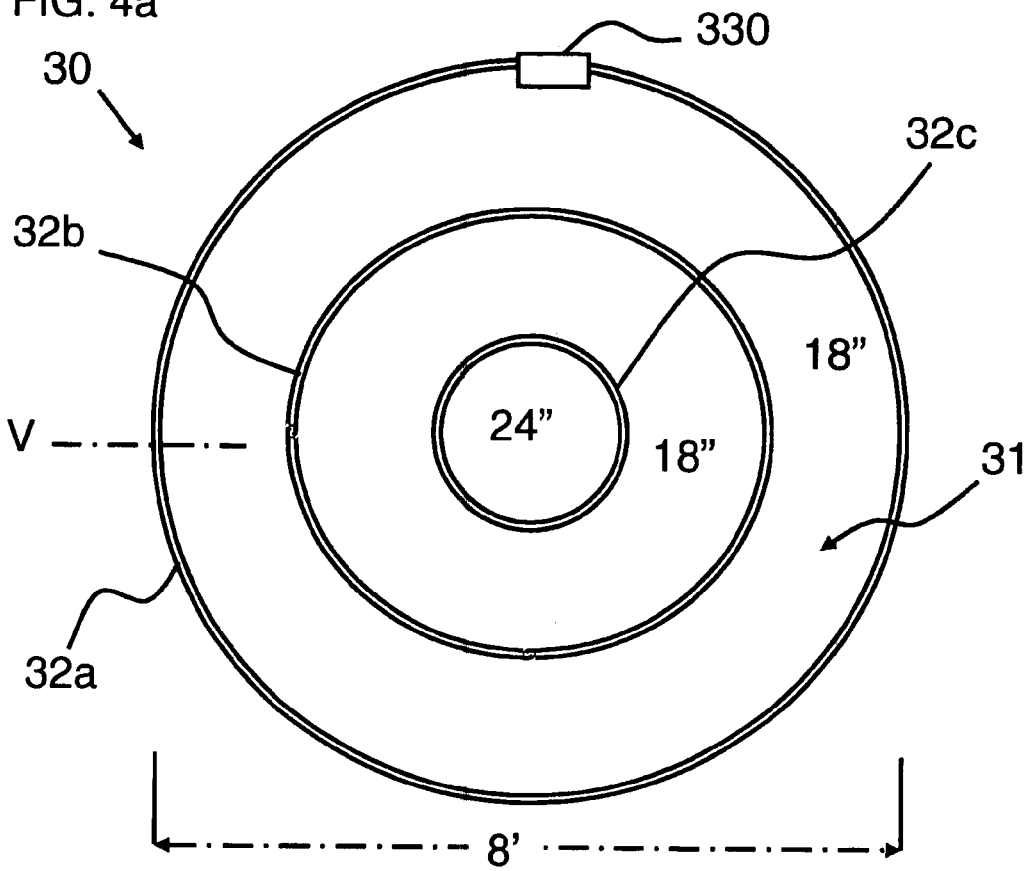
FIG. 4*a* illustrates an aerial view of an embodiment of a target assembly wherein the target assembly is provided with electroluminescent lighting.
Figure 4B:
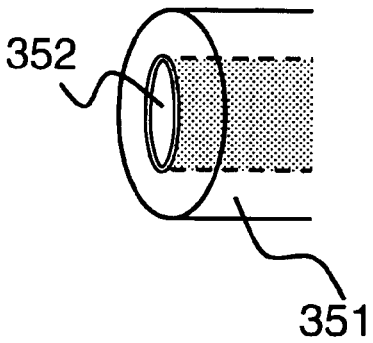
FIG. 4*b* illustrates an embodiment of cross-sectional view taken along line V of FIG. 4*a*, wherein a transparent outer cord shell is provided surrounding an electroluminescent lighting core.
Figure 4C:
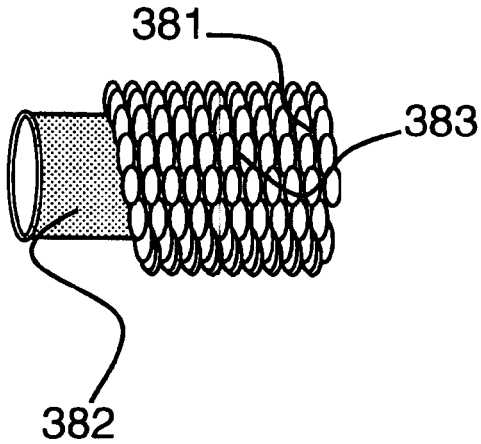
FIG. 4*c* illustrates another embodiment of cross-sectional view taken along line V of FIG. 4*a*, wherein a rope having at least one transparent cable is provided wound or braided around an electroluminescent lighting core.

Target assembly 11 may be comprised of polypropylene rope knotted/welded, or a cord which when laid on the ground and tacked or secured in place with pins, via securing means 19, forms target assembly 11 via ring targets 12*a*-12*n*. In one embodiment, the ring targets 12*a*-12*n* are not interconnected and therefore each must be respectively laid in relation to one another and each secured by at least one securing means 19. Preferably, at least six (6) rings having subsequently larger sizes are provided so that the game can be set-up with the six rings, or as the rings are not interconnected, the game can be set-up using less than all six rings, such as skipping placement of every other ring thereby creating a greater area between each ring. Preferably, the rope or cord composing target assembly 11 comprises an outer surface with phosphorous particles bound thereto for glow-in-the-dark properties for night or evening play, or play in foggy or misty conditions. Optionally, the rope or cord of the target assembly 11 comprises an outer surface constructed with at least one transparent portion surrounding an electroluminescent lighting core as is shown in FIGS. 4*a*-4*c* and discussed infra.

Target assembly 11 preferably has a diameter of ten feet (10'), where there are four target rings 12*a* -12*d*, as shown. Preferably, target assembly 11 has at least three target rings. Each ring target 12*a*-12*n*, 12*a*-12*d* herein, is assigned a point value and has a ring diameter. Herein, the ring diameter of 12*a*, 12*b*, and 12*c* is sixteen inches (16") and the inner most ring 12*d* has a ring diameter of twenty-four inches (24"). The point value assigned to each respective ring 12*a*-12*n*, may vary and is preferably 7, 5, 3, 1 (with 7 points being assigned to 12*d*, 5 points to 12*c*, 3 points to 12*b*, and 1 point to 12*a*). A play line demarcation 14 may further be provided. Herein play line 14 is located thirty feet (30') from target assembly 11. Play line 14 may be constructed as a rope, and may be connected to target assembly 11 via rope 17 (shown in phantom) to outermost ring 12*a*, so that the distance of 30 feet (distance may vary) is adhered to without the need to measure same.

Figure 1B:
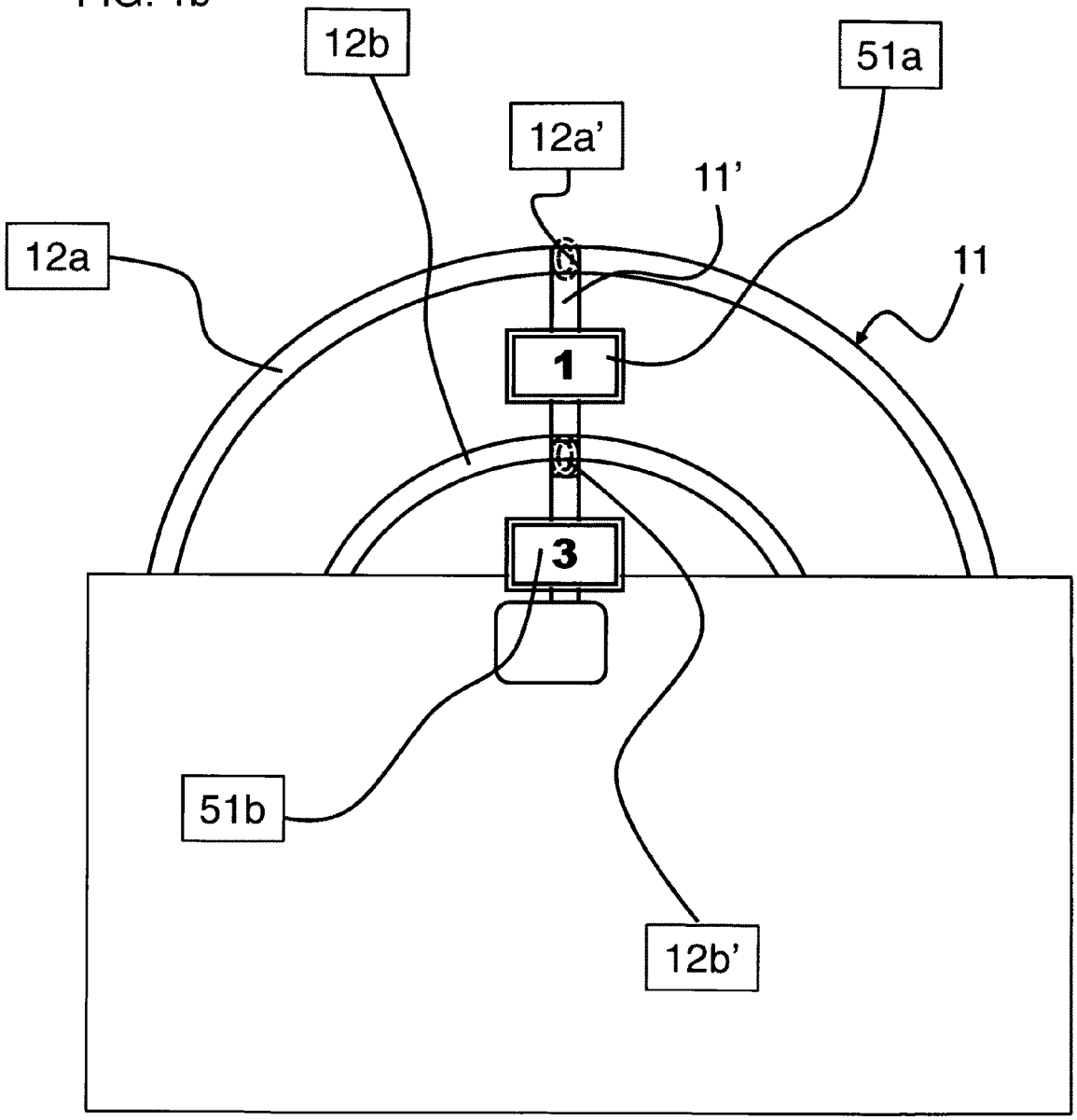
FIG. 1*b* illustrates a cross-sectional view taken along line X of FIG. 1*a* showing interconnection of the concentric rings via connection portions.

FIG. 1*b* illustrates a cross-sectional view taken along line X of FIG. 1*a* showing interconnection of the concentric rings via connection portions. Referring to both FIGS. 1*a* and 1*b*, alternatively target assembly 11 is composed of a rope or cord with at least one connection portion 11' extending between each of concentric rings 12*a*-12*d* so that rings 12*a*-12*d* are interconnected to one another and thus yielding a target assembly 11 having a substantially unitary body. In this manner, the unitary body of the target assembly 11 has advantages in that it allows the user to simply place the target assembly 11 onto the ground without the need to arrange rings 12*a*-12*d* in relation to one another as connection portion 11' provides constant spacing apart of concentric rings 12*a*-12*d*. Connection portions 11' may be removable from each related concentric ring 12*a*-12*d* so that the rings 12*a*-12*d* can be removed to create a varying number of concentric rings 12*a*-12*d* making up target assembly 11. Removability of connection portion 11' may be facilitate by including mating snap portions 12*a*', 12*b*', or hook and loop portions (such as hook and loop portions sold under the trademark Velcro®) on rings 12*a*-12*d* and connection portion 11'. Additionally, connection portions 11', as shown in FIG. 1*b*, may include removable point segments 51*a*, 51*b* relating to each of rings 12*a*, 12*b*, with respective point values assigned thereon so that point segments 51*a*, 51*b* show the respective point value assigned to each of concentric ring 12*a*-12*d* and players can readily ascertain their points. Respective point values may be provided with an outer number surface with phosphorous bound thereto for glow-in-the-dark properties for visibility during night or evening play, or play in foggy conditions.

In another embodiment, the target assembly 11 may be composed of the rope or cord forming the concentric rings 12*a*-12*d* and further include a mesh material spanning between each of concentric rings 12*a*-12*d* so that concentric rings 12*a*-12*d* are interconnected to one another. Securing means 19 can readily be inserted through the mesh, as the mesh is constructed having a plurality of holes therein (as mesh typically is constructed). The mesh may includes removable point segments with respective point values indicated thereon—similar to that discussed hereinabove and shown in FIG. 1*b*. The point segments may be connected via mating snaps or hook and loop portions (such as hook and loop portions sold under the trademark Velcro®) located on the underside of the point segments and the top side of the mesh located between rings 12*a*-12*d*.

Figure 2A:
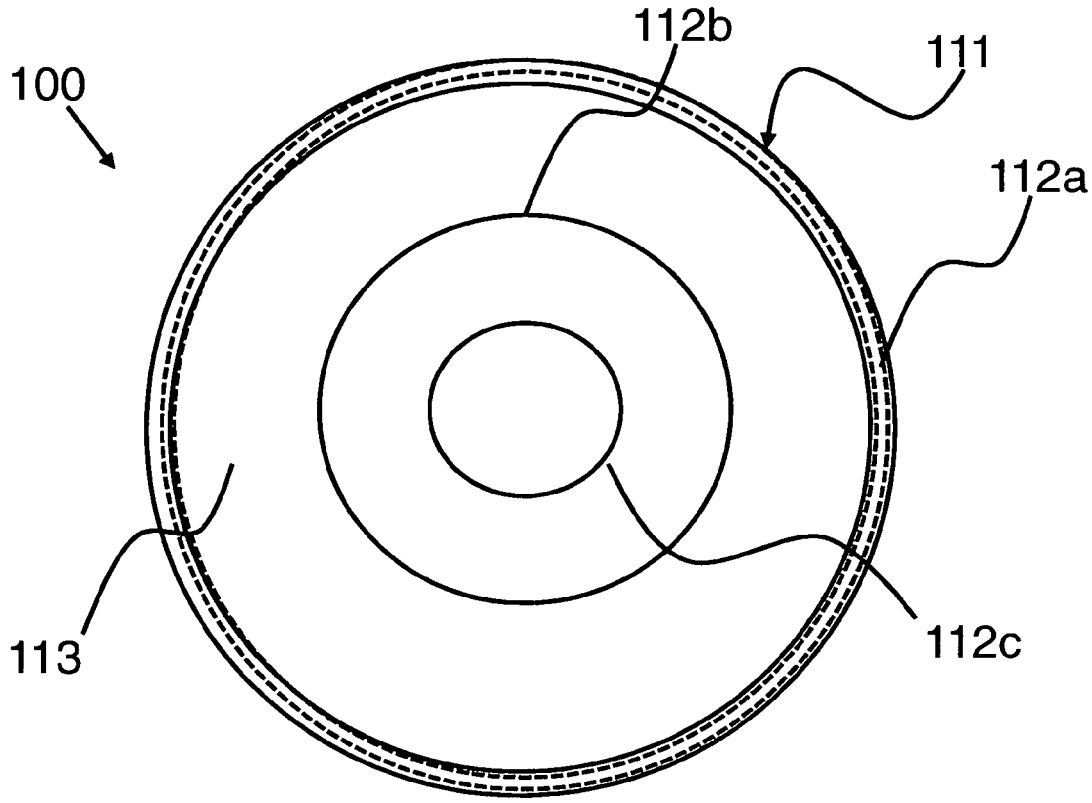
FIG. 2*a* illustrates another embodiment of the target assembly, wherein the target assembly comprises an outermost flexible deformable ring under tension and surrounded by a mesh material, as shown in the open configuration.
Figure 2B:
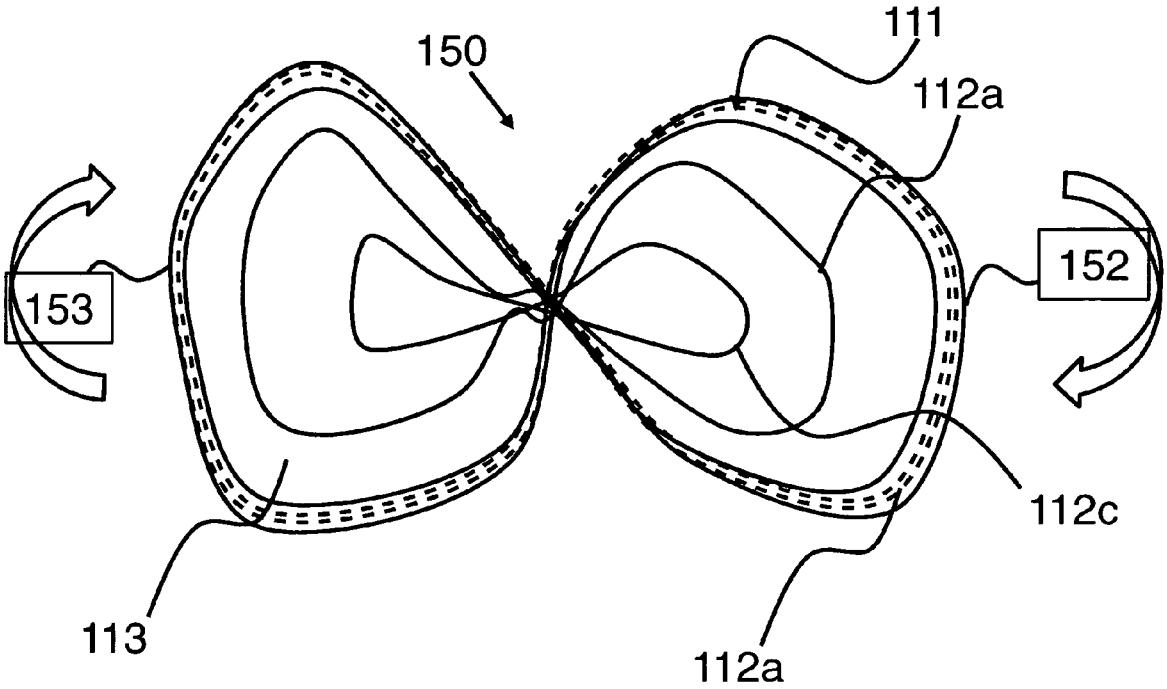
FIG. 2*b* illustrates the embodiment of the target assembly shown in FIG. 2*a* wherein the assembly is being folded.
Figure 2C:
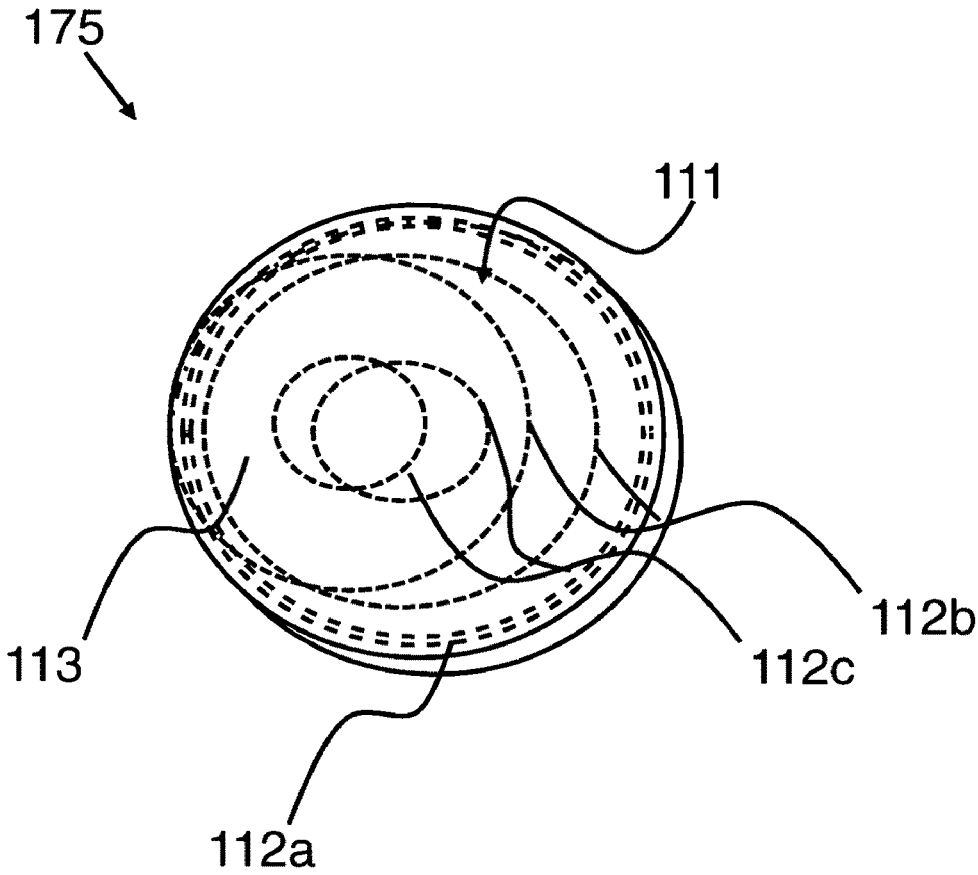
FIG. 2*c* illustrates the embodiment of the target assembly shown in FIG. 2*a* wherein the assembly has been folded as per FIG. 2*b* to yield the folded configuration.

FIG. 2*a*-2*c* illustrate another embodiment of the target assembly, wherein the target assembly comprises an outermost flexible deformable ring under tension and surrounded by a mesh material. Particularly: FIG. 2*a* illustrates another embodiment of the target assembly, wherein the target assembly comprises an outermost flexible deformable ring under tension and surrounded by a mesh material, as shown in the open configuration generally at 100; FIG. 2*b* illustrates the embodiment of the target assembly shown in FIG. 2*a* wherein the assembly is being folded, shown generally at 150; and FIG. 2*c* illustrates the embodiment of the target assembly shown in FIG. 2*a* wherein the assembly has been folded as per FIG. 2*b* to yield the folded configuration, shown generally at 175. In this embodiment, target assembly 111 comprises an outermost flexible deformable ring 112*a* under tension surrounded by and encased in a mesh material 113 to form the main target body of target assembly 111. Target assembly 111 includes concentric rings 112*b*-112*c* demarcated therein by stitching or other markings. Target assembly 111 is twisted as shown in FIG. 2*b*, so that sections 152 and 153 are twisted in opposite directions as indicated by the arrows to form a figure eight shown at 150. While twisting, rings 112*b* and 112*c* as well as outermost flexible deformable ring 112*a* become distorted and outermost flexible deformable ring 112*a* (as well as stitched rings 112*b* and 112*c*) is twisted to yield two overlapping smaller rings which fold upon themselves and one another to yield a folded condition/folded configuration as shown at 175 in FIG. 2*c*, for easy, flat storage within the container. When target assembly 111 is removed from the container, outermost flexible deformable ring 112*a* springs open to yield the open play condition/open configuration shown in FIG. 2*a*.

Figure 3A:
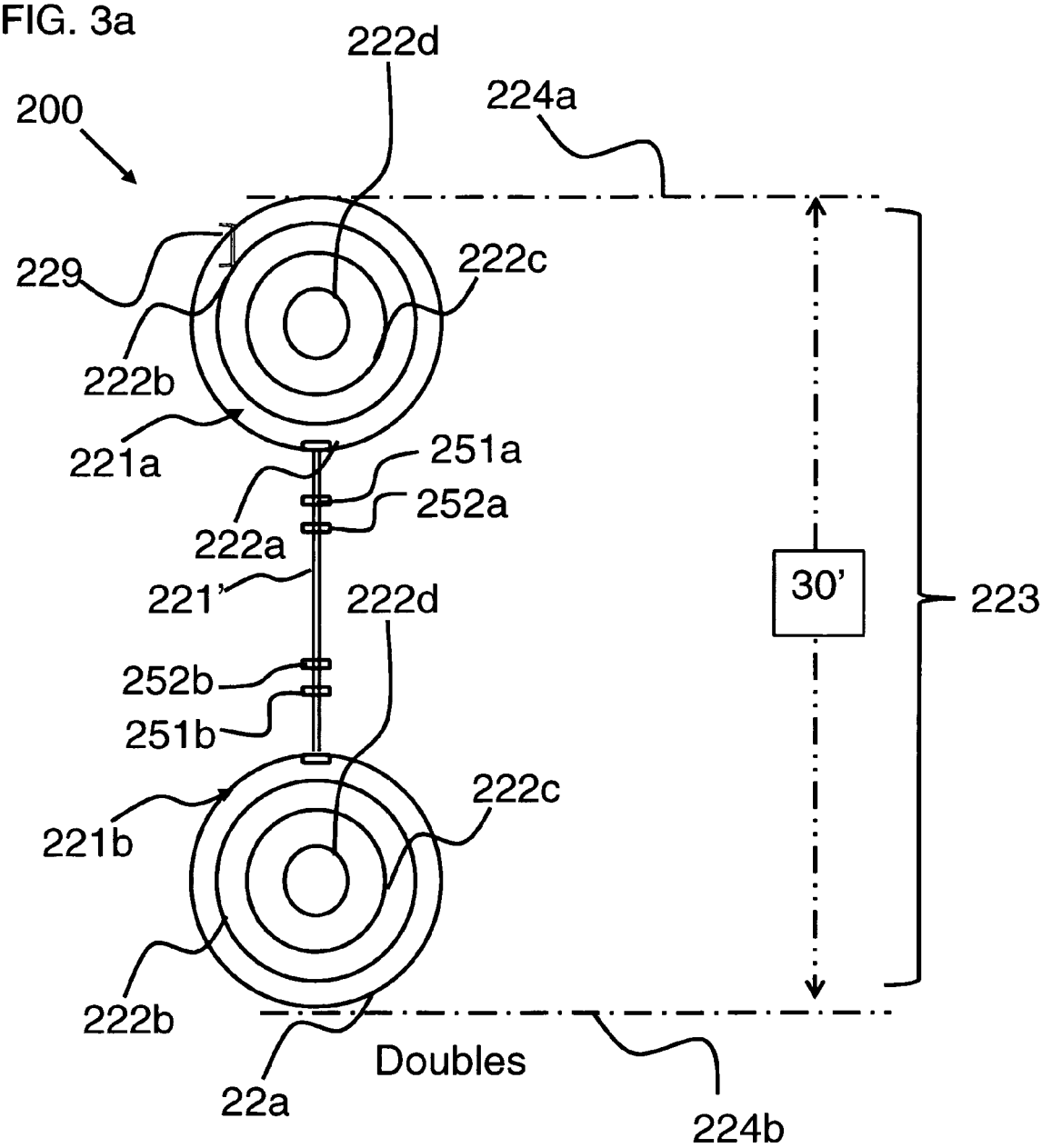
FIG. 3*a* illustrates an aerial view of the target ball game kit assembled on the ground for a doubles game.

FIG-3*a* illustrates an aerial view of the target ball game kit assembled on the ground for a doubles game, shown generally at 200.

Figure 3B:
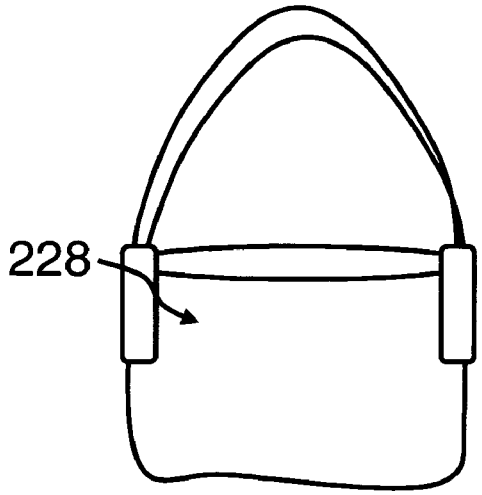
FIG. 3*b* illustrates an embodiment of a kit container shown as a bag.

FIG. 3*b* illustrates an embodiment of a kit container shown as a bag.

Figure 3C:
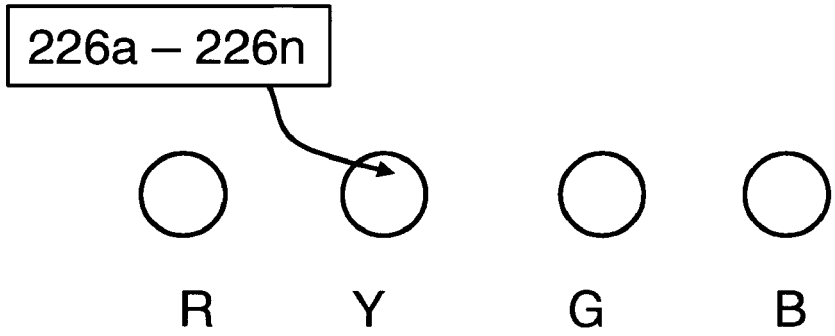
FIG. 3*c* illustrates an embodiment of a plurality of balls.

FIG. 3*c* illustrates an embodiment of a plurality of balls.

Figure 3D:
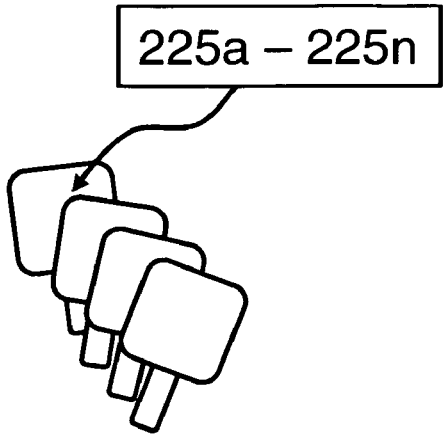
FIG. 3*d* illustrates an embodiment of a plurality of paddles.

FIG. 3*d* illustrates an embodiment of a plurality of paddles. Target ball game kit 200 includes a kit container 228, herein shown as a bag, being portable in nature, housing a plurality of paddles 225*a*-225*n* and balls 226*a*-226*n*. Like paddles 225, varying balls 226 are provided for the different game play levels, novice, intermediate and professional, and vary accordingly in weigh, color and characteristics. Preferably, balls 226 are coated with or include therein a glow in the dark substance for night play. Herein, two court assemblies 221*a* and 221*b* are provided. Court assemblies 221*a* and 221*b* are spaced so that play line 224*a* and 224*b* are 30 feet apart, and may include at least one connection portion 221' so that the courts 221*a* and 221*b* can be set-up at a given distance apart (equal to the connection portion 221') without the need to measure the distance between same every time the court assemblies 221*a* and 221*b* are erected for game play. This connection portion 221' may include several different measurements for varying the distance between each target assembly 221*a* and 221*b* and is connected via mating snap or hook and loop fasteners (such as sold under the Trademark Velcro®) on each of the outermost rings 222*a* of each target assembly 221*a* and 221*b*. Several different measurements are provided with the mating snap or hook and loop on connection portion 221' being spaced out at given intervals, such as shown by way of 251*a*, 252*a*, 251*b*, 251*b*, etc. Each target assembly 221*a* and 221*b* is appointed to be laid on a ground and secured into place by way of securing means 229 to yield a playing field including a plurality of ring targets, 222*a* -222*n*, herein 222*a* -222*d*.

FIGS. 4*a*-4*c* show embodiments of the target assembly wherein the target assembly includes electroluminescent lighting. FIG. 4*a* illustrates an aerial view of an embodiment of a target assembly at 30; FIG. 4*b* illustrates a cross-sectional view of an embodiment of the assembly, taken along line V of FIG. 4*a*, wherein a transparent outer cord shell is provided surrounding an electroluminescent lighting core; and FIG. 4*c* illustrates a cross-sectional view of an embodiment of the assembly, taken along line V of FIG. 4*a*, wherein a rope having at least one transparent cable is wound or braided around an electroluminescent lighting core.

FIGS. 4*a*-4*c* provide an embodiment wherein the target assembly 31 is comprised of three target rings 32*a*, 32*b* and 32*c*. Each ring target 32*a*-32*c* herein, is assigned a point value and has a ring diameter. Herein, the ring diameter of 12*a* and 12*b* is eighteen inches (18") and the inner most ring 32*c* has a ring diameter of twenty-four inches (24"). Target assembly 31 preferably has a diameter of eight feet (8'), where there are three target rings 32*a*-32*c*, as shown. The point value assigned to each respective ring 32*a*-32*c*, may vary and is preferably 5, 3, 1 (with 5 points to 32*c*, 3 points to 32*b*, and 1 point to 32*a*).

Target assembly 31 may be comprised of polypropylene rope as shown in FIG. 4*c*, which when laid on the ground and tacked or secured in place with pins, via securing means, forms the playing field herein shown. The rope or cord making up the target assembly 31 may include reflective and/or glow-in-the-dark properties, such as phosphorous bound to the fibers. Visibility of the rope of the target assembly may be imparted by incorporating light sticks, electroluminescent lighting strip or ribbon into the structure of the rope. FIG. 4*b* illustrates a cross-sectional view of an embodiment of the assembly wherein a transparent outer cord shell 351 is provided surrounding an electroluminescent lighting core 352 (via electroluminescent light strip or ribbon) so that light is transmitted from the cord. FIG. 4*c* illustrates a cross-sectional view of an embodiment of the assembly wherein a rope 381 having at least one transparent cable 383 is wound or braided around an electroluminescent lighting core 382. Power can be provided to the electroluminescent lighting core 352, 382 in the unilateral target assembly 31 via a power source (such as a battery) 330 that delivers current to electroluminescent lighting source/core 352, 382 via a power control switch (on/off) or alternatively controlled by a light sensor that causes current to become activated when a small quantum of light is received through sensors located on/in proximity to power source 330.

During play, each player stands behind play line [14 (FIG. 1), 224*a*, 224*b* (FIG. 3)] and hits a ball towards the target rings [12*a*-12*d* (FIG. 1), 222*a*-222*d* (FIG.3)]. Scoring is based on the ring [12*a*-12*d* (FIG. 1), 222*a*-222*d* (FIG.3)] wherein the ball [16,226] lands. Each player gets 4 balls; the player with the highest score on any particular turn goes first during the next round. As in darts, all scores count in Target Ball. Balls which roll off or miss the target rings 12*a*-12*d* (FIG. 1), 222*a* -222*d* (FIG.3)] receive zero points.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A target ball game kit, comprising:

a. a kit container that is portable in nature;

b. a plurality of paddles;

c. a plurality of balls having varying weights;

d. at least one target assembly appointed to be laid on a ground surface and secured thereto by way of securing means, said target assembly having a substantially unitary body having at least three interconnected concentric rings wherein each ring is assigned a respective point value and has a different ring diameter descending in diameter by fixed increments; and e. said target assembly comprising an outermost flexible deformable ring under tension and surrounded by a mesh material to form a main target, said main target including said concentric rings demarcated therein by stitching or other markings, so that when said target assembly is twisted to form a figure eight said outermost flexible deformable ring becomes two overlapping smaller rings which fold upon themselves and one another to yield a folded condition for easy, flat storage within said container, and when said target assembly is removed from said container said outermost flexible deformable ring springs to yield an open play condition.

2. A target ball game kit as recited by claim 1, wherein said plurality of paddles comprises a plurality of skill-level paddle sets, wherein each of said skill-level paddle sets are constructed for different game play levels, including novice, intermediate, and professional play levels, and wherein each of said different skill-level paddle sets is demarcated to indicate said skill-level.

3. A target ball game kit as recited by claim 1, wherein each of said paddles is appointed to be visible in dusk or dimly lit conditions by having a glow-in-the-dark material or surface integrated with or removably attached to each of the paddles.

4. A target ball game kit as recited by claim 1, wherein said paddles comprise a rim having a hollow core and a transparent lip, said hollow core being appointed with an electroluminescent light strip housed therein activated by a power source located within a handle portion of said paddle.

5. A target ball game kit as recited by claim 1, wherein said plurality of balls comprise a plurality of skill-level ball sets, wherein each of said skill-level ball sets are constructed for different game play levels, including novice, intermediate, and professional play levels, and wherein each of said different skill-level ball sets is demarcated to indicate said skill-level.

6. A target ball game kit as recited by claim 1, wherein each of said balls is appointed to be visible in dusk or dimly lit conditions by having a glow-in-the-dark material or reflective surface.

7. A target ball game kit as recited by claim 1, wherein said respective point value comprises an outer number surface with phosphorous bound thereto for glow-in-the-dark properties for visibility during night or evening play, or play in foggy conditions.

8. A target ball game kit as recited by claim 1 comprising a play line demarcation member.

9. A target ball game kit as recited by claim 8, wherein said play line demarcation member is connected to said target assembly.

10. A target ball game kit as recited by claim 1, wherein at least two target assemblies are provided for a doubles game.

11. A target ball game kit as recited by claim 1 comprising a coin device for determining play order.

12. A target ball game kit as recited by claim 1 comprising a rule book containing game playing rules and a player score keeping book or journal.

* * * * *